US007429194B2

(12) United States Patent
Poulin et al.

(10) Patent No.: US 7,429,194 B2
(45) Date of Patent: Sep. 30, 2008

(54) CONNECTOR ASSEMBLY

(75) Inventors: Christopher J. Poulin, Carmel, NY (US); Gregory Schwartz, Pound Ridge, NY (US); Peter R. Daly, Yorktown Heights, NY (US)

(73) Assignee: BTX Technologies, Inc., Hawthorne, NY (US)

( * ) Notice: Subject to any disclaimer, the term of this patent is extended or adjusted under 35 U.S.C. 154(b) by 0 days.

(21) Appl. No.: 11/743,017

(22) Filed: May 1, 2007

(65) Prior Publication Data

US 2008/0214038 A1 Sep. 4, 2008

Related U.S. Application Data

(60) Provisional application No. 60/892,480, filed on Mar. 1, 2007.

(51) Int. Cl.
*H01R 13/40* (2006.01)

(52) U.S. Cl. ..... 439/596

(58) Field of Classification Search ..... 439/606, 439/456, 470, 638, 541.5, 601, 610, 596, 439/352, 497
See application file for complete search history.

(56) References Cited

U.S. PATENT DOCUMENTS

| | | | | |
|---|---|---|---|---|
| 3,072,879 | A * | 1/1963 | Crowther | 439/709 |
| 4,449,776 | A * | 5/1984 | Carmo et al. | 439/350 |
| 4,457,576 | A * | 7/1984 | Cosmos et al. | 439/610 |
| 4,924,213 | A * | 5/1990 | Decho et al. | 340/653 |
| 5,192,226 | A * | 3/1993 | Wang | 439/502 |
| 5,315,062 | A * | 5/1994 | Hoshino | 439/446 |
| 5,427,550 | A * | 6/1995 | Jaag | 439/709 |
| 5,545,054 | A * | 8/1996 | Benes et al. | 439/467 |
| 5,920,459 | A * | 7/1999 | Weber et al. | 361/752 |
| 6,478,609 | B1 * | 11/2002 | Davis et al. | 439/470 |
| 6,948,965 | B2 * | 9/2005 | Kumamoto et al. | 439/358 |

* cited by examiner

*Primary Examiner*—Alexander Gilman
(74) *Attorney, Agent, or Firm*—Leason Ellis LLP

(57) ABSTRACT

In one exemplary embodiment, an electrical connector includes a D-subminiature connector assembly including a base, a D-subminiature connector mounted to the base, and a terminal block mounted to the base and spaced from the D-subminiature connector. The terminal block has individual terminal openings for receiving wires associated with an electrical cable. Each terminal opening is defined by an axis that intersects a plane containing the base. The electrical connector also includes a hood receiving and holding the D-subminiature connector assembly.

23 Claims, 11 Drawing Sheets

CONNECTOR ASSEMBLY

CROSS REFERENCE TO RELATED APPLICATION

The present application claims the benefit of U.S. patent application Ser. No. 60/892,480, filed Mar. 1, 2007, which is hereby incorporated by reference in its entirety.

TECHNICAL FIELD

The present invention relates generally to an electrical connector and more particularly, an electrical connector that is used in combination with a hood and cable assembly for electrically connecting one member to another member.

BACKGROUND

It is often necessary and desirable to electrically connect one component to another component especially in the ever expanding world of computers and electronics, especially in multi-media applications and settings. A number of different interfaces can be used depending upon the precise nature of the setting.

More specifically, it is often necessary in the low voltage electronic systems integration industry, such as home theater, broadcasting and audio visual, to interconnect many different devices that create a whole system. A large portion of these devices use D-subminiature connectors as the external connection medium. D-subminiature connectors are readily and easily visible in such devices as computer monitors (high density 15 pin D-subminiature), control systems (9 pin standard D-subminiature), video switchers (9 pin standard D-subminiature), audio switchers (25 pin standard D-subminiature) just to name a few.

The D-subminiature connectors are typically installed in a wide number of locations and settings, many of which have specific special constraints. For example, the D-subminiature connectors can be installed in custom cabinetry, surface mount electrical boxes, floor pockets, and other space-limited locations. Unfortunately, there are a number of deficiencies and limitations that are present when trying to install connectors into these locations that have special constraints.

SUMMARY

In one exemplary embodiment, an electrical connector includes a D-subminiature connector assembly including a base, a D-subminiature connector mounted to the base, and a terminal block mounted to the base and spaced from the D-subminiature connector. The terminal block has individual terminal openings for receiving wires associated with an electrical cable. Each terminal opening is defined by an axis that intersects a plane containing the base. The electrical connector also includes a hood that receives and holds the D-subminiature connector assembly. For example, the terminal openings are formed at an angle relative to the plane containing the base such that the terminal openings do not exceed the height of the D-subminiature connector and still allow for the wires to be routed over the terminal block behind it as well as leaving enough space for a hood to be applied.

In another embodiment, the electrical connector includes a D-subminiature connector assembly formed of a base, a D-subminiature connector mounted to the base, and a terminal block mounted to the base and spaced from the D-subminiature connector. The terminal block has individual terminal openings for receiving wires associated with an electrical cable. The connector also includes a hood for receiving and holding the D-subminiature connector assembly. The hood is in the form of a clamshell type hood defined by a first part and a second part pivotally attached to the first part. Each of the first and second parts includes a flexible strain relief portion for receiving the cable that is electrically connected to the terminal block and a body portion that receives the D-subminiature connector assembly. The opposing flexible strain relief portions define an entrance into the body portion.

In addition, the body portion of the second part can include a locking catch that releasably engages a notch formed in the base of the D-subminiature connector assembly to releasably interlock the D-subminiature connector to the hood.

In another embodiment, the electrical connector includes a D-subminiature connector assembly that is formed of a base, a D-subminiature connector mounted to the base, and a terminal block mounted to the base and spaced from the D-subminiature connector. The D-subminiature connector has a plurality of electrical contacts surrounded by a shield that protrudes forward of a flange and the terminal block has individual terminal openings for receiving wires associated with an electrical cable.

The electrical connector also includes a hood for receiving and holding the D-subminiature connector assembly. The hood is in the form of a clamshell type hood defined by a first part and a second part pivotally attached to the first part. Each of the first and second parts includes a flexible strain relief portion for receiving the cable that is electrically connected to the terminal block and a body portion that receives the D-subminiature connector assembly. The body portions have front edges that define a front of the hood and the connector is configured such that the flange of the connector is flush with the front of the hood so as to eliminate any overhang of the hood relative to the connector flange.

BRIEF DESCRIPTION OF THE DRAWING FIGURES

The foregoing and other features of the present invention will be more readily apparent from the following detailed description and drawings figures of illustrative embodiments of the invention in which.

DETAILED DESCRIPTION OF PREFERRED EMBODIMENTS

Figure 1A:
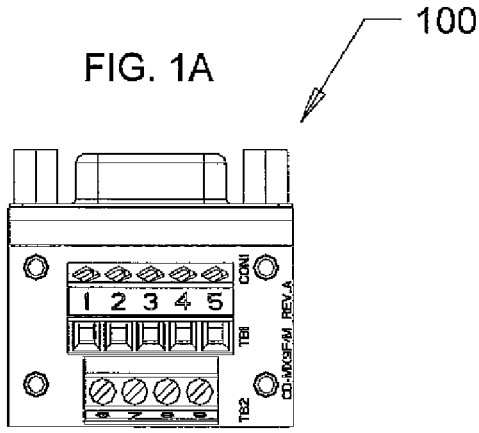
FIG. 1A is a top plan view of a connector assembly according to a first embodiment of the present invention.
Figure 1B:
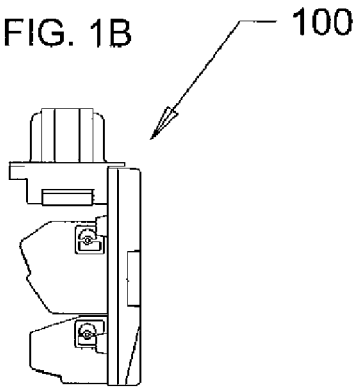
FIG. 1B is a side elevation view of the connector assembly of FIG. 1A.
Figure 2A:
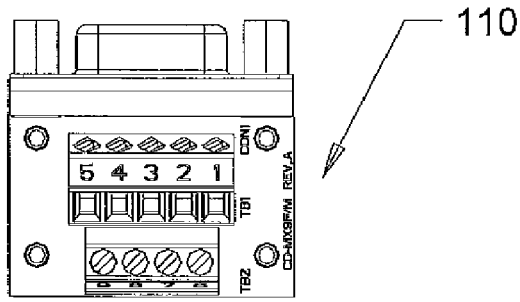
FIG. 2A is a top plan view of a connector assembly according to a second embodiment of the present invention.
Figure 2B:
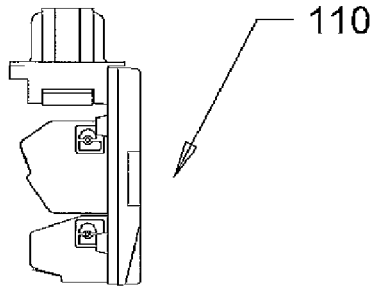
FIG. 2B is a side elevation view of the connector assembly of FIG. 2A.
Figure 3A:
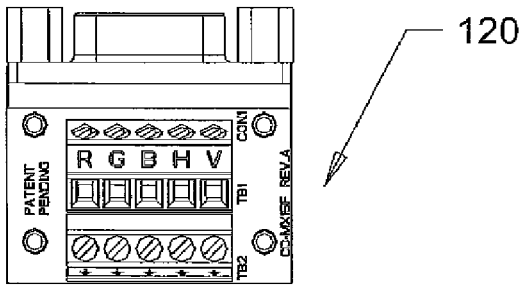
FIG. 3A is a top plan view of a connector assembly according to a third embodiment of the present invention.
Figure 3B:
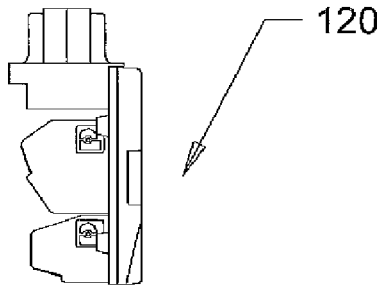
FIG. 3B is a side elevation view of the connector assembly of FIG. 3A.
Figure 4A:
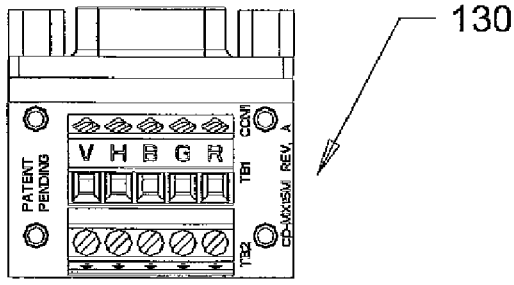
FIG. 4A is a top plan view of a connector assembly according to a fourth embodiment of the present invention.
Figure 4B:
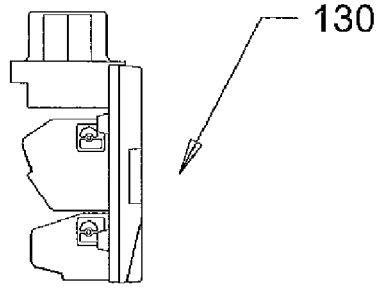
FIG. 4B is a side elevation view of the connector assembly of FIG. 4A.

Now referring to FIGS. 1A and 1B, a D-subminiature connector assembly 100 according to a first embodiment of the present invention is illustrated. The connector assembly 100 is of a standard density 9 pin female design. FIGS. 2A and 2B show a D-subminiature connector 110 according to a second embodiment. The connector assembly 110 is of a standard density 9 pin male design. FIGS. 3A and 3B show a D-subminiature connector assembly 120 according to a third embodiment. The connector assembly 120 is of a high density 15 pin female design. FIGS. 4A and 4B show a D-subminiature connector assembly 130 according to a fourth embodiment. The connector assembly 130 is of a high density 15 pin male design.

Figure 5:
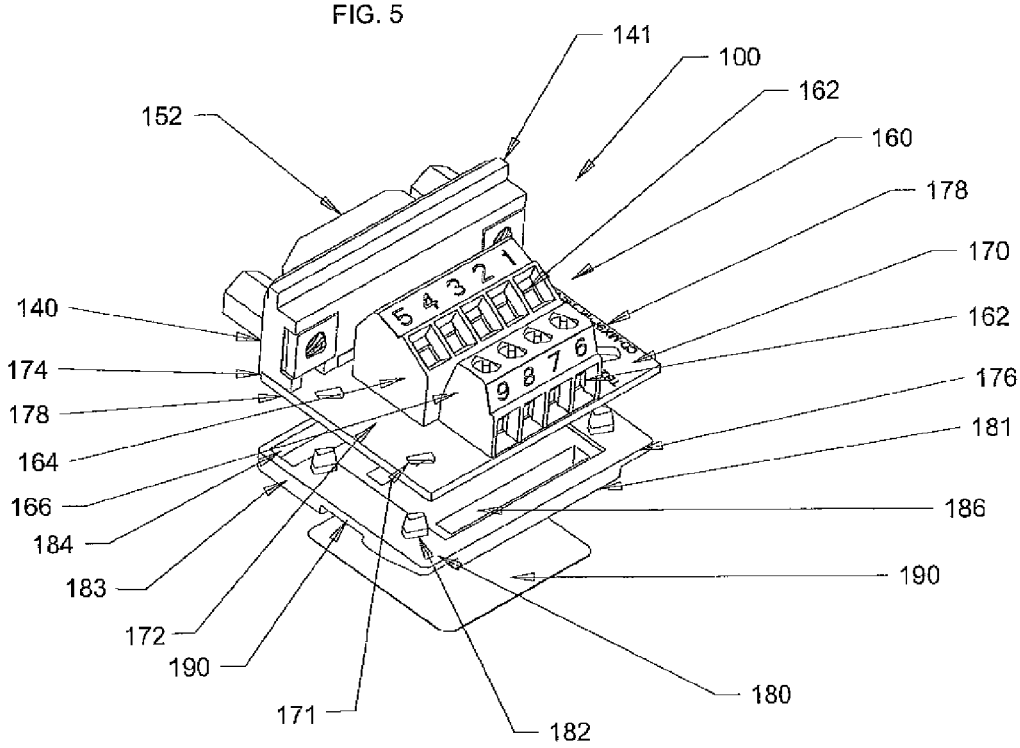
FIG. 5 is an exploded perspective view of the connector assembly of FIGS. 1A and 1B.

FIG. 5 is an exploded view of the D-subminiature electrical connector assembly 100 according to FIGS. 1A and 1B. The electrical connector assembly 100 includes a first connector component (D-sub component) 140 that includes one or more rows of sockets 150 (FIGS. 9A and 9B) that are surrounded by D-shaped shield 152 (plastic or metal) that provides screening against electromagnetic interference. The D-shape guarantees correct orientation. It will be understood that the nomenclature "D-subminiature" is a connector system and it defines a range of connectors with varying numbers of poles (contacts) and further, there is most often, a "shell size" nomenclature that is associated with D-subminiature connectors and in particular, with the dimensions of the shield 152. Shield 152 extends forward of a flange 141 that is part of the connector 140.

With such parts, a D is used as the prefix for the whole series, followed by a letter denoting the shell size (A=15 pin, B=25 pin, C=37 pin, D=50 pin; E=9 pin), followed by the actual number of pins, followed by the gender (M=male, F=female). Further, D-subminiature connectors also come in standard and high density. For instance, a 9 pin D-sub and a high density 15 pin D-sub both utilize the "E" shell size. Therefore, anywhere a 9 pin D-sub can be placed, a high density 15 pin D-sub can likewise be used.

The connector assembly 100 also includes a terminal block 160 that includes a number of openings (terminals) 162 that receive and retain wires or the like that are then electrically connected to the contacts of the D-subminiature connector 140 by means of a conductive pattern (leads) that provide an electrical pathway between each pin of the D-subminiature connector 140 and the conductive wire or the like that is inserted and retained within one terminal 162 of the block 160. For purpose of illustration, a cable 161 is illustrated in the figures and it will be understood that the cable 161 includes a number of individual wires 163 (FIG. 9A) that are inserted into the individual terminals of the terminals as described below.

In the illustrated embodiment, the terminal block 160 includes two rows of the terminals 162, namely, a first terminal row 164 and a second terminal row 166. In the case of a 9 pin design, as shown, the first terminal row 164 includes 5 terminals 162 (so numbered terminals 1-5) and the second terminal row 166 includes 4 terminals 162 (so numbered terminals 6-9). The first terminal row 164 is disposed between the second terminal row 166 and the D-subminiature connector 140. Since the second terminal row 166 includes a less amount of terminals, the second terminal row 166 has a width less than a width of the first terminal row 164.

Unlike conventional terminals block design, the wire entry on the first terminal block row 164 that is closest to the D-subminiature connector 140 has an angled wire entry so that the wires 163 (FIGS. 9A and 9B) are angled as they enter the first terminal block row 164. In particular, the terminal openings are formed at an angle relative to the plane containing the base such that the terminal openings do not exceed the height of the D-subminiature connector and still allow for the wires to be routed over the terminal block behind it as well as leaving enough space for a hood to be applied. For example, the angle of entry for the wires in the first terminal block row 164 can be about 55 degrees. Conventionally, both rows of terminal blocks have straight wire entry from the rear, such as the entry in second terminal row 166.

By angling the entry into the first terminal block row 164, the overall height of the connector assembly 100 can be significantly reduced. This provides a number of advantages that are discussed in greater detail below and in particular, it allows the connector assembly 100 to be used with a hood 200 made in accordance with the present invention and described in detail below.

The assembly 100 also includes a substrate 170 that includes a floor 172 to which the D-subminiature connector 140 and terminal block 160 are attached and typically, the substrate 170 has either a rectangular or square shape that is defined by a front edge 174, an opposing rear edge 176 and a pair of side edges 178 that extend therebetween.

The assembly 100 further includes a cover 180 that mates with the substrate 170 and also interfaces with a printed circuit board 190. The cover 180 is designed to protect the printed circuit board 190 and is thus, disposed between the printed circuit board 190 and the substrate 170. In order to permit the cover 180 to be coupled to the substrate 170, the cover 180 and substrate 170 include complementary features that permit the secure coupling between the two. For example, the substrate 170 can include one or more openings or slots 171 and the cover 180 includes one or more protrusions 182 that serve as locating means for aligning the substrate 170 and cover 180 relative to one another, as well as serving as coupling means. In particular, the protrusions 182 are received into the corresponding openings 171. A heat staking process (a controlled melting of protrusions 182) between the protrusions 182 and the openings 171 results in the coupling between the two members.

It will therefore be appreciated that the cover 180 has a complementary shape relative to the substrate 170. Accordingly, the cover 180 is generally a square shape with two opposing end edges 181 and two opposing side edges 183.

In the illustrated embodiment, the openings 171 are in the form of a first pair of openings that are formed on the sides of the first terminal block row adjacent the D-subminiature connector 140 and a second pair of openings that are formed on the sides of the second terminal block row near the edge of the substrate 170.

The cover 180 also includes a first recess 184 for accommodating the pins of the D-subminiature connector 140 and a pair of slots 186 for accommodating the terminal blocks 160. The recess 184 and slots 186 protect the contacts from being damaged and possibly shorting to one another. This design also allows a reduction in the overall height of the connector assembly 100 as opposed to more of a "tray" type cover design that is used in conventional connector assemblies. The recess 184 and slots 186 also permit the connector assembly 100 to be used with the hood 200 of the present invention, which is described in detail below. In the illustrated embodiment, the recess 184 and slots 186 are in the form of rectangular slots; however, it can be other shapes. The recess 184 is formed below the D-subminiature connector 140 to permit the pins thereof to be accommodated and one slot 186 is formed between the protrusions 182.

The protective cover 180 also includes one or more notches 190 formed therein and in particular, the notch 190 is formed along one side edge 183. Each notch 190 matches up with the hood 200.

Figure 7:
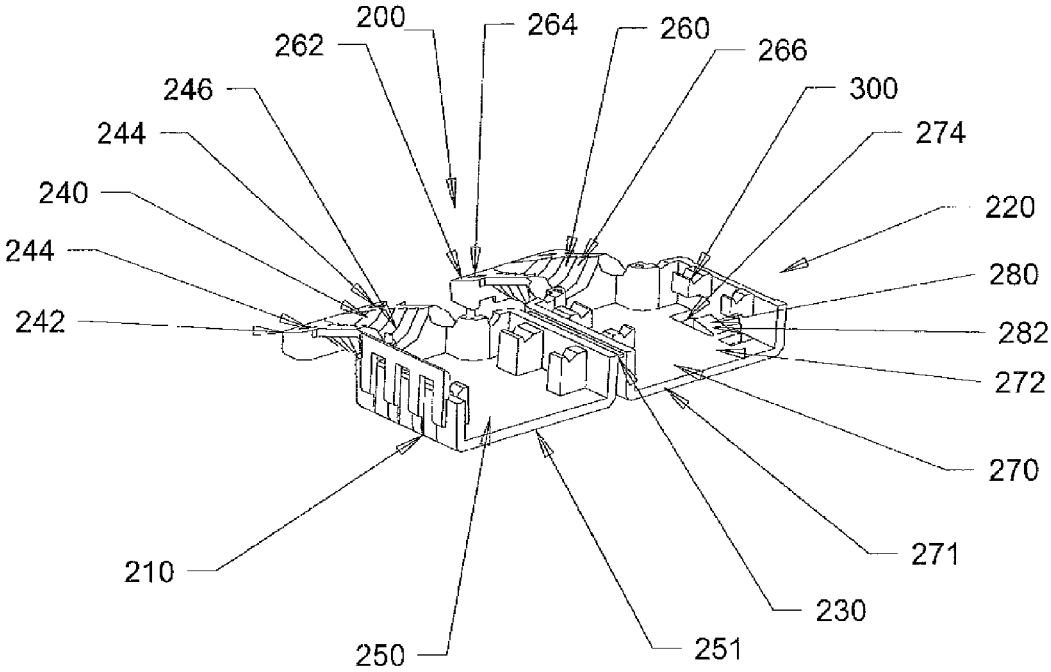
FIG. 7 is a perspective view of a hood according to one embodiment of the present invention in an open position.
Figure 8:
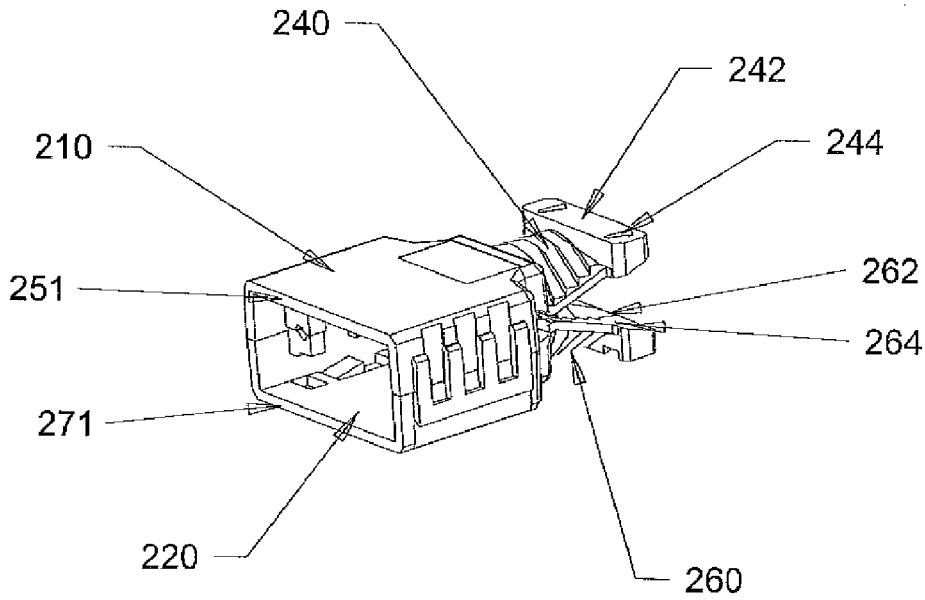
FIG. 8 is a perspective view of a hood according to one embodiment of the present invention in a closed position.

Referring to FIG. 7, the hood 200 in accordance with one embodiment of the present invention is in the form of a clamshell type hood and includes a first part or first half 210 and a second part or second half 220 with a hinge element 230 being formed between the first and second parts 210, 220 to permit pivoting of the two parts 210, 220 relative to one another. The first part 210 has an integrated strain relief component 240 that is designed to receive and engage the wire or cable 161 (FIG. 9B) that is electrically connected to the terminal block 160 and also includes a main body or receptor 250 that receives and holds the D-subminiature connector 140. In the illustrated embodiment, the strain relief component 240 has an end portion 242 that includes one or more openings 244 and a cradle portion 246 which generally has a semi-circular shape for receiving and cradling the cable 161 when the two parts 210, 220 are closed. One end of the strain relief component 240 forms an entrance into the main body 250. The cradle portion 246 can have a tapered construction from front to rear.

The second part 220 is similar to the first part 210 in that it includes an integrated strain relief component 260 that is designed to receive and engage the wire or cable 161 that is electrically connected to the terminal block 160 and also includes a main body or receptor 270 that receives and holds the D-subminiature connector 140. In the illustrated embodiment, the strain relief component 260 has an end portion 262 that includes one or more openings 264 and a cradle portion 266 which generally has a semi-circular shape for receiving and cradling the cable 161 when the two parts 210, 220 are closed. One end of the strain relief component 240 forms an entrance into the main compartment 270.

In the illustrated embodiment, the first part 210 forms the top of the hood 200 and the second part 220 forms the bottom of the hood 200 and as a result, the second part 220 is designed to releasably capture and interlock and engage the D-subminiature connector 140. In other words, one difference is that the main compartment 270 of the second part 220 includes a flexible catch or latch 280 formed along a floor 272 of the main body 270. The floor 272 has an opening 274 that is formed near or at the intersection between one vertical wall that defines the main body 270 and the floor 272. The catch 280 is in the form of a flexible tab that extends into the opening 274 such that when a force is applied, the catch 280 flexes downwardly into the opening 274. The catch 280 has a ramped surface 282 that increases in thickness toward the strain relief portion 260.

It will be appreciated that when the first and second parts 210, 220 are closed and mated together, the two cradle portions 246, 266 define a generally circular shaped cavity that receives the cable 161 which is gripped and held between the cradle portions 246, 266 as described below. Similarly, the two main bodies 250, 270 define a generally rectangular shaped cavity that receives the D-subminiature connector 140. Front edges 251, 271 of the main bodies 250, 270 define an opening 290 through which the D-subminiature connector 140 is received as the connector 140 is mated with and securely held within the hood 200.

It will be appreciated that at least in the above described embodiment, the hood 200 has a clamshell type configuration in that once the D-subminiature connector 140 is received within the lower part 220 and locked thereto, as described below, the upper part 210 pivots about the hinge member 230 so as to capture and hold the D-subminiature connector 140 therebetween.

Figure 13A:
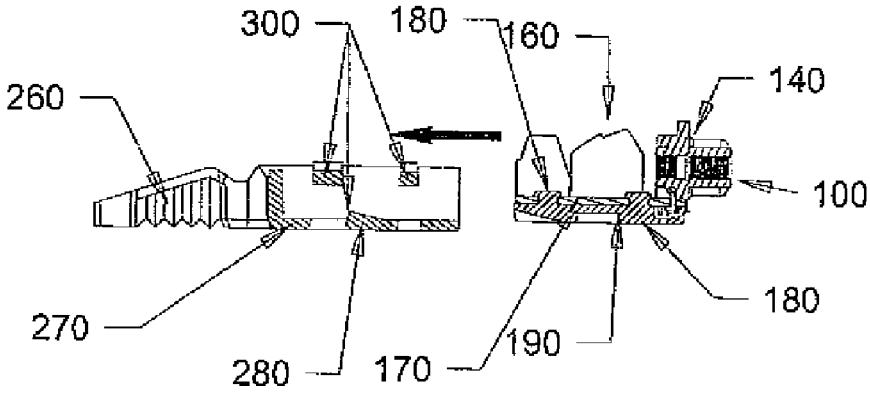
FIG. 13A is an exploded cross-sectional view showing the connector assembly prior to insertion into the hood.
Figure 13B:
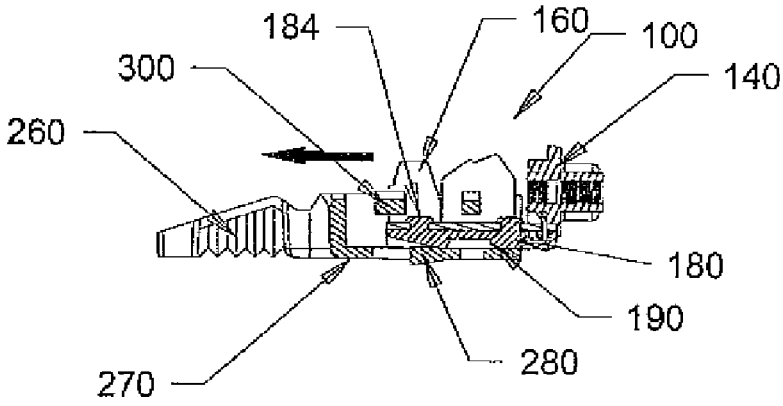
FIG. 13B is an exploded cross-sectional view showing the connector assembly partially inserted into the hood but prior to interlocking therebetween.
Figure 13C:
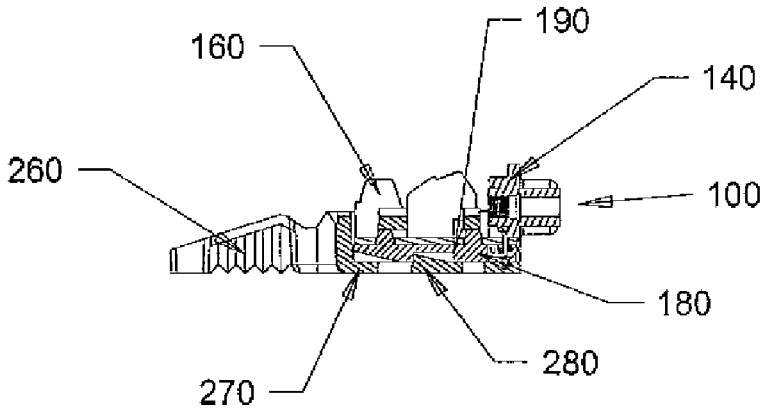
FIG. 13C is an exploded cross-sectional view showing the connector assembly inserted into and interlocked with the hood.

Now referring to FIGS. 9A, 9B and 13A-13D, the D-subminiature connector 140 can be installed according to a clamshell method. As shown in FIG. 13A, the D-subminiature connector 140 is interlocked with the bottom part 220 by laying the cable 161 within the cradle portion 266 and the protective cover 180 attached to the D-subminiature connector 140 is inserted into the bottom part 220 by sliding the cover 180 along the floor 272 such that the cover 180 rides up the inclined ramp 282 of the catch 280, thereby causing the downward flexing of the catch 280 into the opening 274 as shown in FIG. 13B. The D-subminiature connector 140 is further slid along the floor 272 toward the strain relief portion 260 until the notch 190 of the protective cover 180 is in registration (aligned) with the catch 280. Once this registration occurs, the biased nature of the catch 280 causes the catch 280 flex upwardly into the notch 190. Since the shape and dimensions of the catch 280 are complementary to the notch 190, the catch 280 at least partially enters the notch 190 and is securely held therein, thereby preventing any further sliding movement of the D-subminiature connector 140 along the floor 272 of the part 220. This locked position is shown in FIG. 13C.

In the locked position, the inward edge of the D-subminiature connector assembly is adjacent the interface between the strain relief portion 260 and the body portion 270. This interface can be defined by a vertical end wall that has an arcuate groove or opening that defines the open end of the cradle portion that forms the entrance into the body portion 270.

In order to securely hold the D-subminiature connector 140 within the hood 200, one or more vertical side walls of the main body 270 can contain one or more tabs or projections 300 that are spaced from the floor 272. As can be seen in FIG. 13C, when the D-subminiature connector 140 slides along the floor 272 and is placed into the locked position with the catch 280 engaging the notch 190, the protrusions 184 of the protective cover 180 they extend through the complementary openings in the substrate 170 seat against the underside of tabs 300.

Figure 9A:
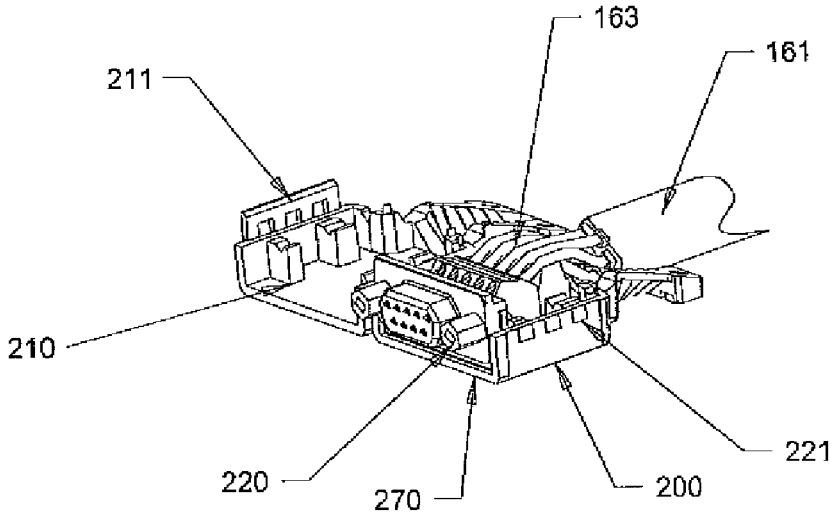
FIG. 9A is an exploded perspective view of an assembly including the connector assembly according to the present invention received into the open hood of FIGS. 7 and 8.

As shown in FIG. 9A, the first and second parts 210, 220 of the hood 200 include attachment means for releasably attaching the two parts 210, 220 to one another. For example, the first part 210 can include a first attachment means 211 in the form of flexible rail with openings formed therein. The second part 220 includes a second attachment means 221 in the form of spaced tabs formed on the outside of one side wall of the body portion 270. The spacing between the tabs 221 is the same as the spacing of the openings in the rail 211 and therefore, when the first and second parts 210, 220 are closed, the tabs 221 are received in the openings of the flexible rail 211, thereby releasably coupling the two parts together. To disengage, the flexible rail 211 can be pulled up to disengage the tabs from the openings.

Once the D-subminiature connector 140 is placed in this locked position and the cable 161 lies within the strain relief portion 260 of the second part 220, the first part 210 is closed on top of the second part 220. As this occurs, the strain relief portions 240, 260 capture the cable 161 and the body portions 250, 270 capture the D-subminiature connector 140. Fasteners 310 (FIG. 9B) are inserted into and through the openings 244 of strain relief portion 240 and through openings 264 of strain relief portion 260 so as to securely couple the portions 240, 260 together, with the cable 161 being pinched therebetween.

Figure 13D:
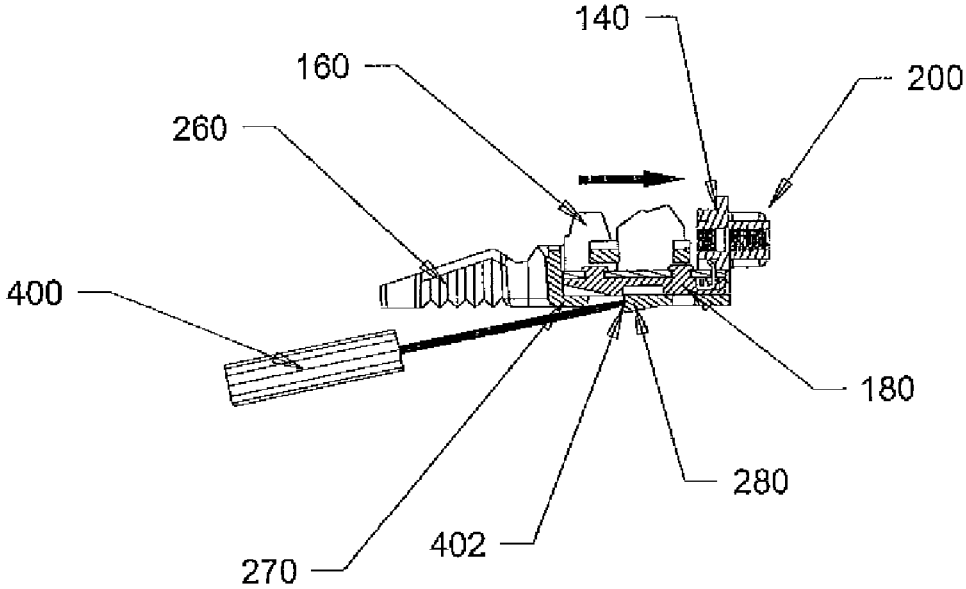
FIG. 13D is an exploded cross-sectional view showing a tool releasing the connector assembly from its interlocked state with the hood.

FIG. 13D shows a means for disengaging and releasing the D-subminiature connector 140 from the hood 200 and in particular, a tool 400 is inserted into opening 274 and into contact with the catch 280. The tool 400 is then manipulated so as to cause the catch 280 to flex downward until the catch 280 disengages from the notch 190, thereby freeing the D-subminiature connector assembly from the hood 200. At this time, the D-subminiature connector can be slid out of the hood 200 in a direction way from the strain relief portions 240, 260. The tool 400 can be an elongated tool, such as a screwdriver type object, that has an end 402 that engages the catch 280.

Figure 10A:
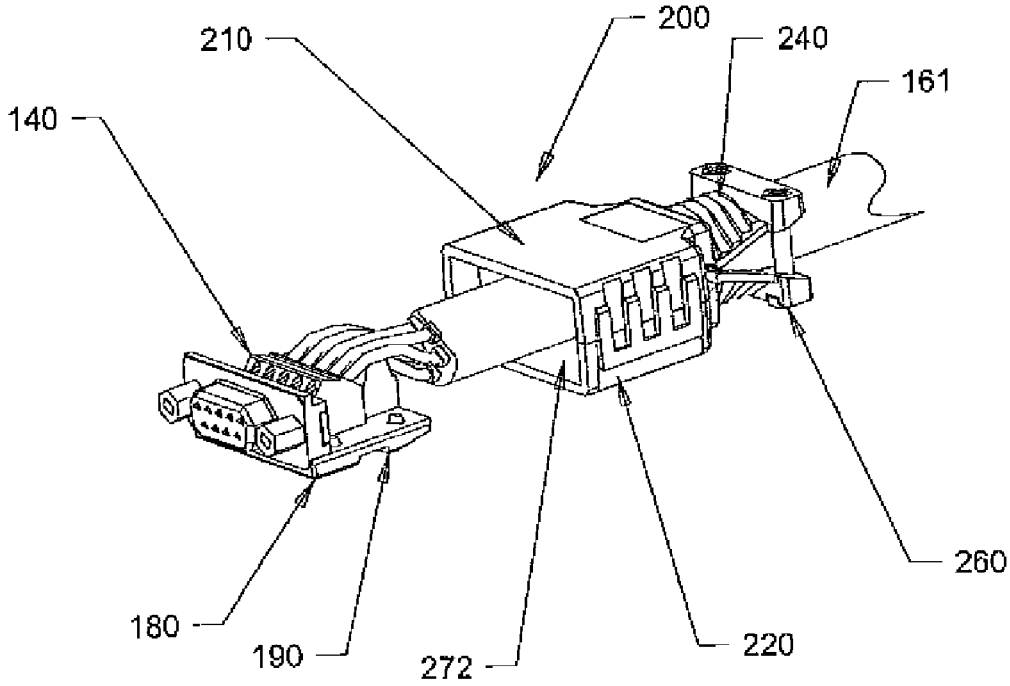
FIG. 10A is an exploded perspective view of an assembly including the connector assembly according to the present invention received into the closed hood of FIGS. 7 and 8.
Figure 10B:
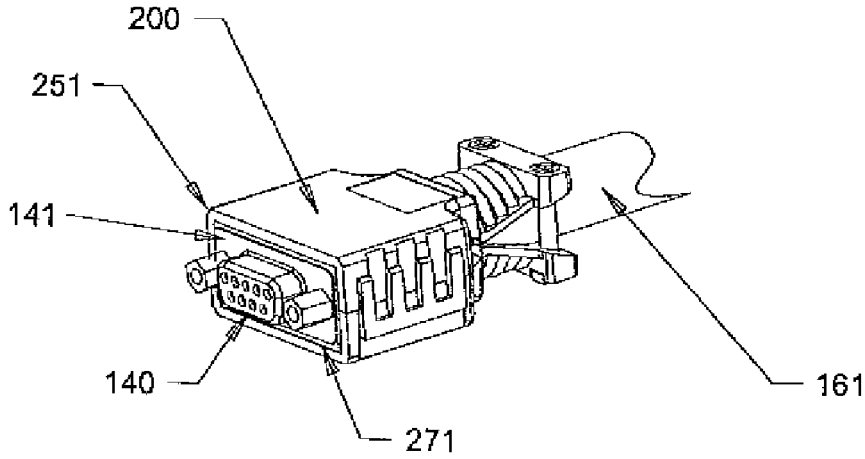
FIG. 10B is a perspective view of the assembly of FIG. 10A with the connector assembly being received into the hood in a click and slide manner to capture the connector.

FIGS. 10A and 10B illustrate another method of installing the D-subminiature connector 140 into the hood 200 in a "slide and click" method. In this embodiment, the first and second parts 210, 220 of the hood 200 are already attached to one another and the connector 140 is initially outside of the hood 200 except for the cable 161 that extends through the strain relief portions 240, 260 and the body portions 250, 270. The connector 140 is then slid into the locked hood 200 causing the cover 180 to slide along the floor 272 of the bottom body portion 270 until the catch 280 engages and locks with the notch 190 as described below.

Figure 9B:
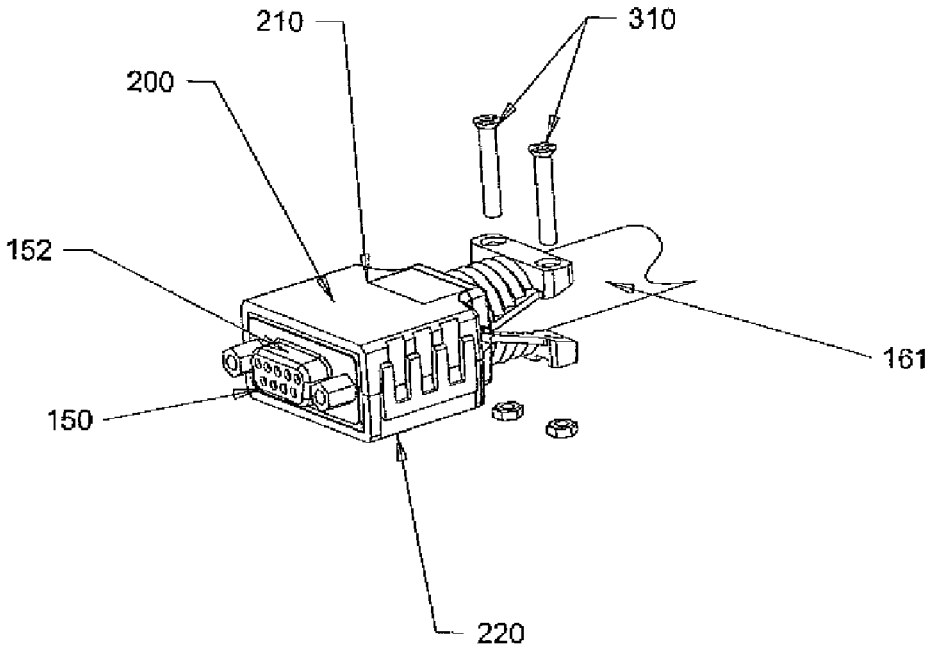
FIG. 9B is a perspective view of the assembly of FIG. 9A with the hood being closed in a clamshell manner to capture the connector assembly.

In other words and as shown in FIGS. 9A and 9B, the hood 200 can be applied to a terminated cable/connector prior to the finished assembly being installed into equipment using the clamshell method. Alternatively and as shown in FIGS. 10A and 10B, the hood 200 can be applied after a terminated cable/connector has been installed onto a piece of equipment or after a terminated connector/cable has been mounted to a panel, plate, chassis, or other surface using the slide and click method.

Figure 6A:
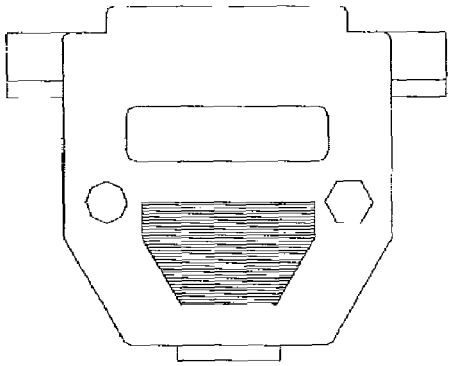
FIG. 6A is a top plan view of a conventional standard D-sub hood (shell) that receives a conventional D-sub connector.
Figure 6B:
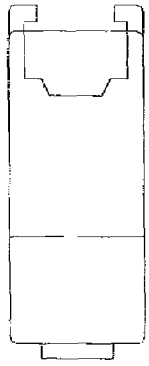
FIG. 6B is a side elevation view of the hood of FIG. 6A.
Figure 11:
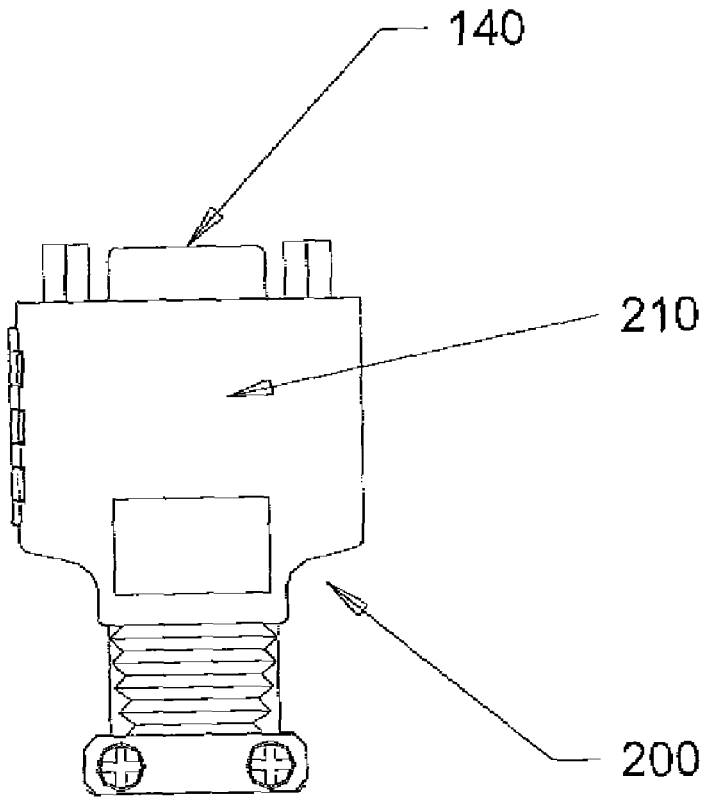
FIG. 11 is a top plan view of the connector assembly according to the present invention received in the closed hood of the present invention.

In accordance with one aspect of the present invention, there is no overhang on the front of the hood (defined by front edges 251, 271 of the main bodies 250, 270). As shown in FIGS. 10B and 11, a flange 141 of the D-subminiature connector 140 is flush with the front edges 251, 271 and this allows the hood 200 to be used while mounted to an object, such as a plate, panel, chassis, box or other surface. This is in contrast to conventional hood design, such as the hood shown in FIGS. 6A and 6B, which is marked by an overhang. As shown in FIG. 6B, the front of the conventional connecter held within the conventional hood is not flush with the flange that is part of the connector and therefore, this presents mounting difficulties and limits the range of locations where the assembly can be mounted.

Figure 12A:
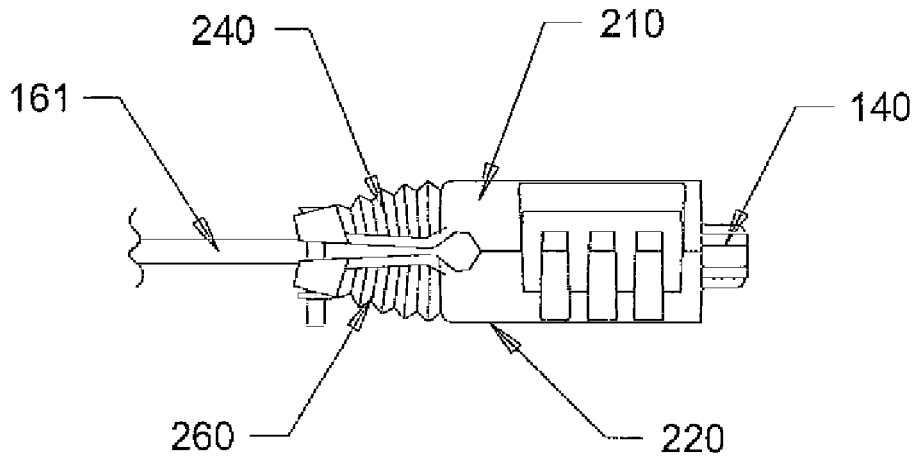
FIG. 12A is a side elevation view of the assembly of FIG. 11 with the cable grip thereof in a first position gripping a cable having a first diameter.
Figure 12B:
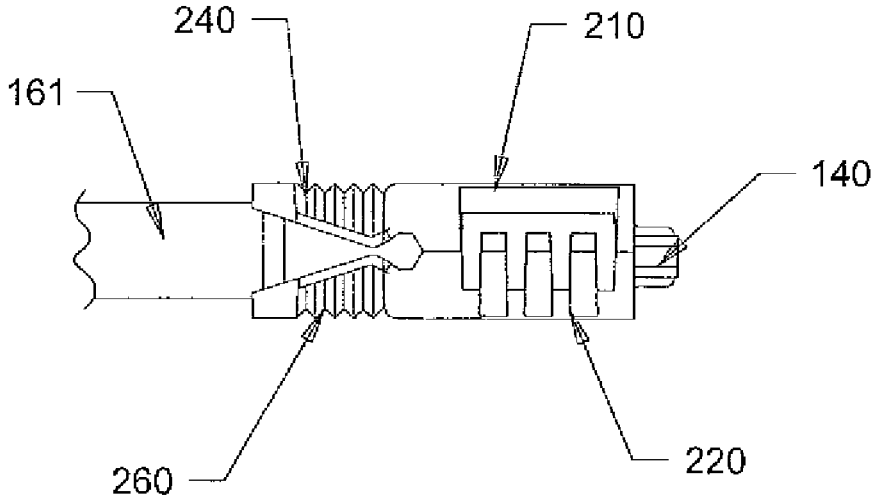
FIG. 12B is a side elevation view of the assembly of FIG. 11 with the cable grip thereof in a second position gripping a cable having a second diameter.

In accordance with one embodiment of the present invention, the integrated strain relief portions 240, 260 are configured so as to be flexible as well as being tapered from the front to the back. FIGS. 12A and 12B show this feature in that FIG. 12A shows the integrated strain relief portions 240, 260 capturing and holding a cable 161 having a first outer diameter and FIG. 12B shows the integrated strain relief portions 240, 260 capturing and holding a cable 161 having a second outer diameter that is significantly greater than the first diameter shown in FIG. 12A. In one embodiment, the strain relief portions 240, 260 allow accommodation of outside cable diameters from about 0.120 inch to about 0.500 inch. Conventional hood designs cannot accommodate this type of cable diameter range.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. An electrical connector comprising:

a D-subminiature connector assembly including:

a base;

a D-subminiature connector mounted to the base;

a terminal block mounted to the base and spaced from the D-subminiature connector, the terminal block having individual terminal openings for receiving wires associated with an electrical cable, each terminal opening being defined by an axis that extends therethrough and intersects a horizontal plane containing the base; and a hood receiving and holding the D-subminiature connector assembly, wherein the D-subminiature connector assembly interlockingly engages at least one portion of the hood independently of hood closure such that when the hood is in an open position, the D-subminiature connector assembly remains interlocked in place within the hood.

2. The electrical connector of claim 1, wherein the terminal openings are formed at an angle relative to the plane containing the base such that the terminal openings do not exceed the height of the D-subminiature connector.

3. The electrical connector of claim 2, wherein the terminal block includes a first terminal block having the angled terminal openings and a second terminal block that includes terminal openings that are defined by an axis that is parallel to the horizontal plane.

4. The electrical connector of claim 2, wherein the terminal openings are formed at an angle of about 55 degrees relative to the plane containing the base.

5. The electrical connector of claim 1, wherein the base comprises a substrate to which the D-subminiature connector and terminal block are mounted and a protective cover that is for placement over a printed circuit board and is arranged on an underside of the substrate, the protective cover having integral interlocking members that mate with complementary interlocking members formed as part of the at least one portion of the hood for securely attaching the connector assembly to the hood.

6. The electrical connector of claim 5, wherein the protective cover has a first recess formed therein to receive contacts of the D-subminiature connector and a pair of slots formed therein to receive contacts of the terminal blocks.

7. The electrical connector of claim 1, further including a locking mechanism that permits the D-subminiature connector assembly to be releasably interlocked with the hood.

8. The electrical connector of claim 1, wherein the locking mechanism comprises a flexible locking catch that is part of the hood and releasably engages a notch formed in the base of the D-subminiature connector assembly when the D-subminiature connector assembly is inserted into the hood to releasably interlock the two.

9. The electrical connector of claim 8, wherein the locking catch comprises a flexible tab having a ramped outer surface, the tab extending into an opening formed in a floor of the hood, the D-subminiature connector assembly being releasably interlocked with the hood when the flexible tab engages the notch formed in the protective cover of the base.

10. The electrical connector of claim 1, wherein the hood comprises a clamshell type hood defined by a first part and a second part pivotally attached to the first part, the assembly being interlockingly coupled to the first part.

11. The electrical connector of claim 10, wherein each of the first and second parts includes a flexible strain relief portion for receiving the cable that is electrically connected to the terminal block and a body portion that receives the D-subminiature connector assembly, the flexible strain relief portion defining an entrance into the body portion.

12. The electrical connector of claim 11, wherein the body portion of the second part includes a locking catch that releasably engages a notch formed in the base of the D-subminiature connector assembly to releasably interlock the D-subminiature connector to the hood.

13. The electrical connector of claim 12, wherein the locking catch comprises a flexible tab having a ramped outer surface, the tab extending into an opening formed in a floor of the body portion of the second part, the D-subminiature connector assembly being releasably interlocked with the hood when the flexible tab engages the notch formed in the base.

14. The electrical connector of claim 11, wherein the strain relief portion has a tapered construction from a front section to a rear section thereof and is formed of a flexible material to allow the opposing strain relief portions of the first and second parts to accommodate cables of different diameters, the strain relief portions being located adjacent a wall of the hood against which the terminal block abuts.

15. The electrical connector of claim 14, wherein the opposing strain relief portions accommodate cables having outside diameters between about 0.120 inch and about 0.500 inch.

16. An electrical connector comprising:

a D-subminiature connector assembly including:

a base;

a D-subminiature connector mounted to the base;

a terminal block mounted to the base and spaced from the D-subminiature connector, the terminal block having individual terminal openings for receiving wires associated with an electrical cable; and a hood receiving and holding the D-subminiature connector assembly, the hood being a clamshell type hood defined by a first part and a second part pivotally attached to the first part, each of the first and second parts including a flexible strain relief portion for receiving the cable that is electrically connected to the terminal block and a body portion that receives the D-subminiature connector assembly, the opposing flexible strain relief portions defining an entrance into the body portion, wherein the hood includes a front surface that is flush with a mounting surface of the D-subminiature connector resulting in the mounting surface being free of any interference from the hood, wherein the first and second parts include a strain relief portion for receiving the cable that is electrically connected to the terminal block, the strain relief portion being formed of first and second housings, each of which has a cylindrical bellows construction having inner teeth, wherein in an open position, each housing has an angled ramp both of which converge at inner ends thereof and in a closed position, the ramps are drawn closer together.

17. The electrical connector of claim 16, wherein the body portion of the second part includes a flexible locking catch that releasably engages a notch formed in the base of the D-subminiature connector assembly to releasably interlock the D-subminiature connector to the hood.

18. The electrical connector of claim 17, wherein the locking catch comprises a flexible tab having a ramped outer surface, the tab extending into an opening formed in a floor of the body portion of the second part, the D-subminiature connector assembly being releasably interlocked with the hood when the flexible tab engages the notch formed in the base.

19. The electrical connector of claim 16, wherein the strain relief portion has a tapered construction from a front section to a rear section thereof and is formed of a flexible material to allow the opposing strain relief portions of the first and second parts to accommodate cables of different diameters.

20. The electrical connector of claim 19, wherein the opposing strain relief portions accommodate cables having outside diameters between about 0.120 inch and about 0.500 inch.

21. The electrical connector of claim 16, wherein each terminal opening is defined by an axis that extends therethrough and intersects a horizontal plane containing the base.

22. The electrical connector of claim 21, wherein the terminal openings are formed at an angle relative to the plane containing the base such that the terminal openings do not exceed the height of the D-subminiature connector.

23. An electrical connector comprising:

a D-subminiature connector assembly including:

a base including a substrate and a protective cover that is for placement over a printed circuit board and is arranged on an underside of the substrate between the circuit board and the substrate, the protective cover protects against shorting of circuitry of the assembly and includes a first coupling member;

a D-subminiature connector mounted to the substrate, the D-subminiature having a plurality of electrical contacts surrounded by a shield that protrudes forward of a flange thereof;

a terminal block mounted to the substrate and spaced from the D-subminiature connector, the terminal block having individual terminal openings for receiving wires associated with an electrical cable; and a hood receiving and holding the D-subminiature connector assembly, the hood being in the form of a clamshell type hood defined by a first part and a second part pivotally attached to the first part, each of the first and second parts including a flexible strain relief portion for receiving the cable that is electrically connected to the terminal block and a body portion that receives the D-subminiature connector assembly, the body portions having a front edge that define a front of the hood, wherein the flange of the connector that defines a mounting surface of the connector is flush with the front of the hood so as to eliminate any overhang of the hood relative to the mounting surface, wherein the first part of the hood includes a second coupling member that mates with the first coupling member to fixedly attach the assembly to the first part of the hood regardless of and independent from a closure and locking mechanism associated with the hood for locking the first and second parts relative to one another resulting in the connector assembly being positioned within and releasably snap-lockingly coupled to the hood even when the hood is in an open position.

* * * * *